United States Patent [19]
Sharp
[11] 4,231,731
[45] Nov. 4, 1980

[54] MULTIFUEL SELF-REGULATING BURNER

[76] Inventor: Joseph Sharp, 337 S. Stearns Rd., Oakdale, Calif. 95361

[21] Appl. No.: 901,155

[22] Filed: Apr. 28, 1978

[51] Int. Cl.³ ..... F23H 1/00
[52] U.S. Cl. ..... 431/38; 431/247; 431/236
[58] Field of Search ..... 431/37, 38, 236, 237, 431/247

[56] References Cited

U.S. PATENT DOCUMENTS

| | | | |
|---|---|---|---|
| 675,076 | 5/1901 | Wells | 431/104 |
| 1,134,667 | 4/1915 | Brooke | 123/122 C |
| 1,178,779 | 4/1916 | Caldwell | 431/347 |
| 1,230,735 | 6/1917 | Logan | 431/237 |
| 1,403,656 | 1/1922 | Torrey | 431/208 |

*Primary Examiner*—Carroll B. Dority, Jr.
*Attorney, Agent, or Firm*—Nilsson, Robbins, Dalgarn, Berliner, Carson & Wurst

[57] ABSTRACT

An automatic self-regulating burner system. A serpentine pipe structure connected to a source of fuel has a preheating portion, an orifice pipe portion and a backpressure pipe portion. The orifice pipe portion has an orifice therethrough which exhausts vaporized fuel. The exhausted fuel vapor is burned to heat both the preheater pipe portion for vaporizing and preheating the fuel, and the backpressure pipe portion for generating an internal pressure which automatically regulates the quantity of fuel vapors which are exhausted from the orifice.

7 Claims, 2 Drawing Figures

MULTIFUEL SELF-REGULATING BURNER

BACKGROUND OF THE INVENTION

The present invention relates to burners and, in particular, to a burner which is substantially self-regulating where the amount of fuel burned depends substantially on the size of the orifice through which the fuel vapors are exhausted.

Apparatus for preheating fuels in order to achieve more efficient burning are well known. For example, in U.S. Pat. No. 1,134,667, the fuel for an internal combustion engine is preheated by passing the fuel line through the entire length of an exhaust manifold. As another example, in U.S. Pat. No. 675,076, a hydrocarbon burner is disclosed in which a small orifice is placed in one part of a coil in a fuel line. Fuel escaping through the orifice is ignited causing the coil and, thus, the fuel therein, to be heated. The heated fuel is finally exhausted through the end of the coil where the primary burning occurs. A similar type of apparatus was also disclosed in U.S. Pat. No. 1,230,735, where a device is provided for preheating a kerosene fuel line to vaporize the kerosene and thus facilitate burning.

In each of the above patents, however, the primary and essential function is to preheat the fuel to facilitate burning as the fuel is exhausted from a second remote orifice at the end of the fuel line. By contrast, the present invention, while providing a preheating function to facilitate vaporization, also provides a backpressure portion which is also heated for providing a self-regulating capability.

More particularly, the present invention comprises a preheating pipe portion and an enclosed backpressure portion, both of which are heated in the primary burner flame. Connecting the preheater portion and the backpressure portion is an orifice pipe portion having an orifice through which the fuel is exhausted to be burned. It should be noted that, unlike the prior devices, the present invention has only a single orifice means with heat preheating being done in the primary flame. Thus, there is no separate secondary or preheating flame required as is the case with U.S. Pat. Nos. 1,230,735 and 675,076.

Because the backpressure generated by the present system is believed to simultaneously impede vaporization and promote exhaustion from the orifice, an equilibrium point is achieved at which the backpressure, and the temperature, are believed to be substantially constant. Because the equilibrium point is stable, the backpressure which is proportional to the temperature of the flame, provides a self-regulating effect where the amount of fuel exhausted from the orifice is dependent upon the pressure which, in turn, is dependent upon the temperature of the flame. The values of various parameters to obtain the most efficient burning are believed to occur at the equilibrium condition. In other words, the pressure regulates the amount of fuel exhausted to achieve the highest temperature and, therefore, the highest pressure and consequently the most efficient burning.

The present invention not only provides greater economy by causing the most heat energy to be extracted from a given quantity of fuel, but also provides a burner which is virtually pollution free and which can use any fuel whether liquid or gas. Furthermore, the present invention does not require complex valves or burner jets.

SUMMARY OF THE INVENTION

A multifuel self-regulating burner apparatus which comprises a preheater pipe portion which initially receives fuel from a source thereof, a backpressure pipe portion and an orifice pipe portion which connects the preheater pipe portion and the backpressure pipe portion. The orifice pipe portion has an orifice therethrough for allowing fuel vapors to escape in a direction so that, when the vapors are ignited to produce a flame, heat is applied at least to the backpressure pipe portion.

In the preferred embodiment, the preheater pipe portion is also placed in a position so that at least a portion of the heat generated by the flame is used to preheat the fuel entering the burner apparatus. Although more than one closely spaced orifice may be utilized without departing from the teaching of the present invention, in the preferred embodiment, only a single orifice is utilized. The amount of heat energy produced by the burner may be varied by increasing or decreasing the size of the orifice. The multifuel burner apparatus preferably has a substantially serpentine structure with the preheater pipe portion and the orifice pipe portion defining a first plane and the backpressure pipe portion and the orifice pipe portion defining a second plane. The angle between the first and the second planes is preferably less than about 45° to allow the flame to impinge on both the preheater pipe portion and the backpressure pipe portion, thereby avoiding the use of a separate heater for the preheating portion.

BRIEF DESCRIPTION OF THE DRAWINGS

The present invention will be better understood from the detailed description below taken in conjunction with the drawings wherein like reference characters refer to like parts throughout and in which.

DETAILED DESCRIPTION OF THE PREFERRED EMBODIMENTS

Figure 1:
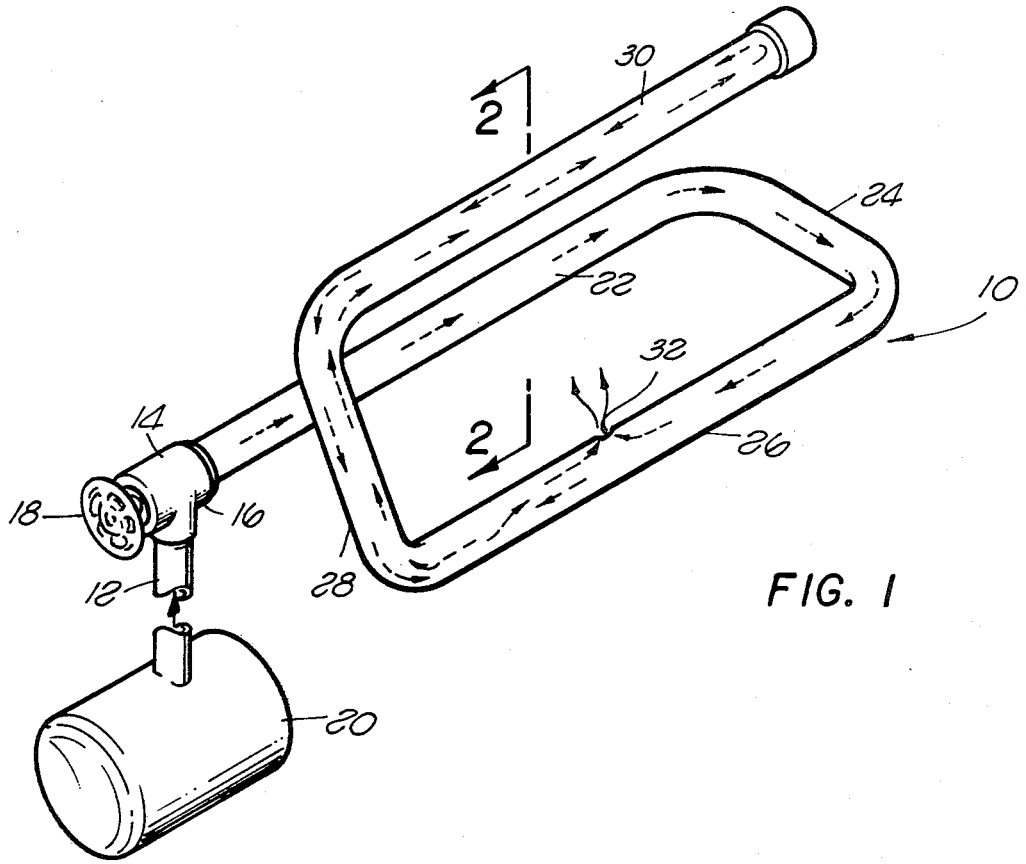
FIG. 1 is a pictorial representation of the burner apparatus of the present invention.

The present invention as illustrated in FIG. 1 provides a novel burner apparatus which provides greatly increased economy in the use of fuel and increases the burning efficiency to a degree that pollution due to unburned or partially burned fuels is substantially eliminated. Furthermore, the present invention can burn any type of vaporous fuel, whether gas or liquid in its initial state before preheating.

Turning to FIG. 1, a structure illustrative of the present invention is shown, including a burner member 10 which is connected to a valve 14 which regulates the flow of a fuel from a source 20 entering the burner apparatus through the supply pipe 12. The burner member 10 may be a single precast pipe or may be comprised of several pipes which are joined together in a continuous configuration. Regardless of the particular configuration, however, the burner member 10 comprises a preheating pipe portion 22 which may be coupled directly to the valve casing 16 of the valve means 14 or may be coupled by intermediate pipe elements (not shown). The preheater portion 22 is coupled to an orifice pipe portion 26 by a preheater connecting pipe portion 24. The orifice pipe portion 26 is also connected to a backpressure pipe portion 30 by a backpressure connecting pipe portion 28. A burner orifice 32 is drilled or otherwise provided in the orifice pipe portion 26.

In the preferred embodiment, the burner orifice 32 is positioned to direct vaporized fuel toward the backpressure pipe portion 30. Thus, when the fuel vapors exhausted from the burner orifice 32 are ignited, the gas or liquid or both contained in the backpressure pipe portion 30 are heated generating a pressure in the enclosed interior of the burner member 10.

In operation, a fuel is supplied through the supply pipe 12 and the valve 14 to the burner member 10. Although the exact principles involved in the present invention are not well understood, it is believed that the primary function of the valve means is to either turn on or turn off the fuel and that the valve means does not substantially contribute to controlling the amount of fuel which is burned.

When the valve means handle 18 is turned on, fuel flows into the preheating pipe portion 22 where the fuel is preheated, preferably utilizing the burner member's own flame. The fuel vapors next pass into the orifice pipe portion 26 and at least partially into the backpressure pipe portion 30 through the backpressure connecting pipe portion 28. As the fuel vapors enter the orifice pipe portion 26, they are exhausted through the burner orifice 32 where they are ignited. Once ignited, the vapor gas mixture in the backpressure pipe portion 30 is heated thereby building-up a backpressure which automatically regulates the amount of vapor exhausted through the burner orifice 32.

Although the exact way in which the present invention operates is not well understood, it is believed that the backpressure built-up due to the heating of the backpressure pipe portion 30 forces more fuel vapors through the orifice while at the same time applying pressure against the fuel entering the burner member 10 thereby impeding the flow of fuel vapors through the orifice 32. These two effects oppose one another, that is, they work to effect opposite results. Thus, for a given pressure, a natural equilibrium will be reached which will cause a specified amount of fuel vapor to escape through the orifice 32. Because this equilibrium point is stable, it can be seen that backpressure causes the burner to be automatic and self-regulating. Furthermore, because the backpressure pipe portion 30 will be preferably placed in the hottest part of the flame, and the temperature thus generated will be substantially constant regardless of the amount of fuel being burned, the amount of heat energy produced by the burner 10 can be increased or decreased by simply varying the diameter of the burner orifice 32 to allow more or less fuel to be exhausted.

In the specific configuration illustrated in FIG. 1, the preheating portion 22 (including the preheater connecting portion 24) and the orifice pipe portion 26 define a first plane and the backpressure pipe portion 30 (including the backpressure connecting pipe portion 28) and the orifice pipe portion 26 define a second plane. The burner member may then be described as a substantially serpentine configuration in the first plane and second plane.

Figure 2:
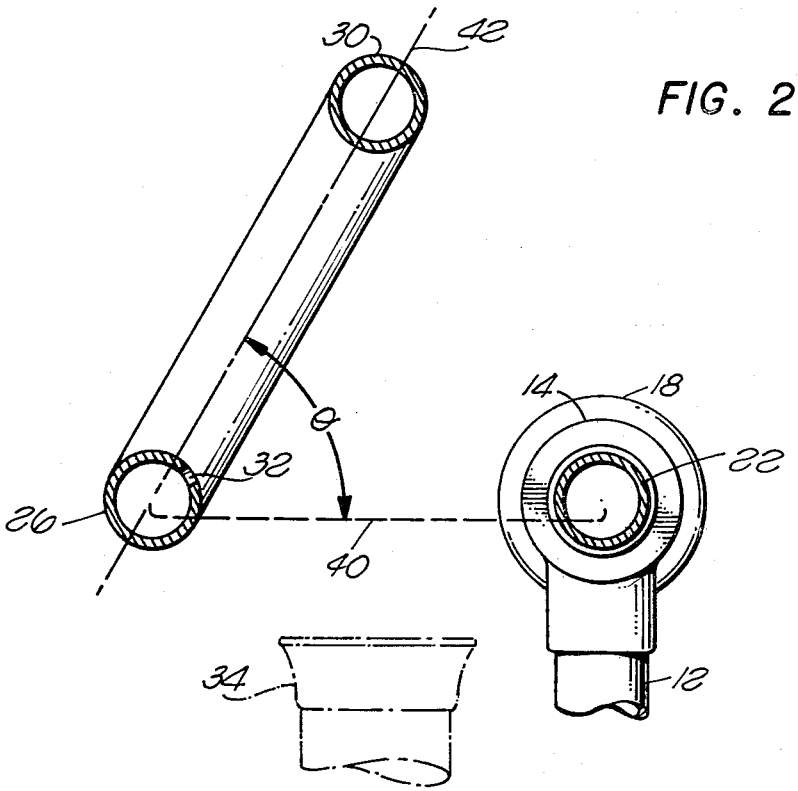
FIG. 2 is an end plan view of the burner apparatus illustrated in FIG. 1 through the section 2—2.

Referring to FIG. 2, an end view of the burner member 10 through the section 2—2 of FIG. 1 is illustrated. Thus, the first plane 40 is defined by the orifice pipe portion 26 and the preheating pipe portion 22 and the second plane 42 is defined by the backpressure pipe portion 30 and the orifice pipe portion 26.

The angle $\theta$ between the plane 40 and the plane 42 is preferably less than about 45° since it is desired to preheat the fuel in the preheating pipe portion 22 with the same flame utilized to heat the backpressure pipe portion 30. The burner orifice 32 is aligned to exhaust fuel vapors substantially along the second plane 42 to allow the backpressure pipe portion 30 to be in the maximum temperature region of the flame.

Of course, it will be appreciated that the preheating in the preheating pipe portion 22 may be done with an auxiliary heater or other separate heating method. It will be further appreciated that the present burner member may use any of a number of different types of fuel without modification. However, if the fuel is a liquid, then the present invention preferably has a starter means 34 which is first ignited prior to turning on the valve 14 (see FIG. 1) so that an initial backpressure can be built-up to prevent liquid fuel from being exhausted through the burner orifice 32. For example, the burner utilizing a liquid fuel may be ignited by placing a piece of charcoal or other carbonaceous material under the burner 10 in the starter means 34. The valve means 14 may then be opened allowing a small quantity of liquid fuel to be sprayed through the burner orifice 32 and onto the carbonaceous material. The carbonaceous material is then ignited to provide a source of heat from the starter means 34. After burning for several minutes, a backpressure in the backpressure pipe 30 is built-up to a sufficient degree to prevent liquid fuel from being expelled from the burner orifice 32. The vapors generated by this heating escape from the burner orifice 32 where they may be ignited. The burner 10 will quickly reach a self-regulating equilibrium and operation proceeds as previously discussed. Of course, various other prestarter methods and apparatus may be utilized without departing from the spirit of the present invention.

There has thus been described a novel burner invention which is self-regulating and which can use any type of fuel, whether liquid or gaseous. Furthermore, the present burner invention produces virtually pollution-free burning without the need for expensive or intricate nozzles or fuel injectors and without the need for manual fuel regulators to vary the amount of fuel burned.

What is claimed is:

1. A multifuel self-regulating burner apparatus for burning a fuel from a supply comprising:

a preheater pipe portion connected for initially receiving the fuel;

a backpressure pipe portion; and an orifice pipe portion connected between the preheater pipe portion and the backpressure pipe portion, the backpressure pipe portion being sealed except at the connection to the orifice pipe portion, the orifice pipe portion having at least one orifice therethrough, said backpressure pipe portion being located forwardly of said orifice and said orifice being positioned for applying heat to at least the backpressure pipe portion when the fuel passing through the orifice is burned.

2. The multifuel self-regulating burner apparatus of claim 1 wherein the fuel from the supply is a liquid and the multifuel burner further comprises a starting heater means for initially heating the preheating pipe portion and the backpressure pipe portion for vaporizing the fuel before exhausting the fuel through the orifice.

3. The multifuel self-regulating burner apparatus of claim 1 further comprising a valve means connected between the supply of fuel and the preheating pipe portion for turning the supply of fuel to the multifuel self-regulating burner apparatus on and off.

4. The multifuel self-regulating burner apparatus of claim 1 wherein the preheater pipe portion and the orifice pipe portion define a first plane and the backpressure pipe portion and the orifice pipe portion define a second plane, the angle between the first and second planes being less than about 45°.

5. The multifuel self-regulating burner apparatus of claim 4 wherein at least one orifice is positioned for exhausting the fuel substantially along the direction of the second plane.

6. The multifuel self-regulating burner apparatus of claim 1 wherein the orifice pipe portion has a single orifice.

7. A multifuel self-regulating burner system for burning a fuel provided from a source comprising:

means for preheating the fuel for providing a quantity of heated fuel vapor;

means for exhausting the heated fuel vapor for feeding a flame; and means for providing a backpressure in the burner system for regulating the rate at which heated fuel vapors are exhausted wherein the value of the backpressure is proportional to the temperature of the flame, the means for providing a backpressure comprising a sealed backpressure pipe portion connected to and located forwardly of the means for exhausting.

* * * * *